US006332730B1

(12) United States Patent
Taghavi-Khanghah

(10) Patent No.: US 6,332,730 B1
(45) Date of Patent: Dec. 25, 2001

(54) CONTAINER VALVE

(75) Inventor: Said Taghavi-Khanghah, Newcastle Upon Tyne (GB)

(73) Assignee: Veresk Biosystems Limited, Newcastle Upon Tyne (GB)

( * ) Notice: Subject to any disclaimer, the term of this patent is extended or adjusted under 35 U.S.C. 154(b) by 0 days.

(21) Appl. No.: 09/762,212

(22) PCT Filed: Jul. 30, 1999

(86) PCT No.: PCT/GB99/02522

§ 371 Date: Feb. 5, 2001

§ 102(e) Date: Feb. 5, 2001

(87) PCT Pub. No.: WO00/07900

PCT Pub. Date: Feb. 17, 2000

(30) Foreign Application Priority Data

Aug. 3, 1998 (GB) ..... 98/02326

(51) Int. Cl.[7] ..... A47L 13/30

(52) U.S. Cl. ..... 401/264; 401/270; 401/186; 222/212; 222/494

(58) Field of Search ..... 401/261–264, 401/270, 268, 273, 183, 186, 145; 222/494, 495, 496, 212, 213

(56) References Cited

U.S. PATENT DOCUMENTS 2,607,515 * 8/1952 Felburg .
2,643,794 * 6/1953 Perkins .
2,695,119 * 11/1954 Kishpaugh .
3,008,611 * 11/1961 Mancusi .
3,345,673 * 10/1967 Schwartzman .
5,325,999 * 7/1994 Gueret ..... 222/212
5,454,494 * 10/1995 Lechelle .

FOREIGN PATENT DOCUMENTS 13 00 060 * 7/1969 (DE) .
20 32 454 * 1/1972 (DE) .
43 29 808 * 3/1995 (DE) .
WO 95 10965 * 4/1995 (WO) .
WO 99 07614 * 2/1999 (WO) .

* cited by examiner

*Primary Examiner*—Charles R. Eloshway
(74) *Attorney, Agent, or Firm*—Larson & Taylor PLC

(57) ABSTRACT

A container comprises a flexible body member (2) closed by a cap portion (26) having an outlet (28) therein, and a control assembly within the cap portion for controlling liquid flow from the body member (2) to the outlet (28), the control assembly comprising an integrally moulded seating (6) for location on the body member (2), including an outer annular sleeve (8) and an inner valve support chamber (12) and a control valve (16) of a one piece plastic moulding located on the seating (6) to define a closed volume therebelow and to seal the outlet, the closed volume being vented to atmosphere, the arrangement being such that, on pressurisation on the interior of the body member (2), the pressurised liquid flows between the sleeve (8) and the chamber (12) to distort the control valve (16) and enable flow through the outlet (28), and, on release of said pressure, the control valve (16) returns to a position sealing the outlet (28).

18 Claims, 6 Drawing Sheets

CONTAINER VALVE

TECHNICAL FIELD

This invention relates to containers, and more particularly to containers for dispensing pastes, gels, creams and other products hereinafter referred to as liquids.

BACKGROUND

There are a variety of containers available for enabling controlled dispensing of the liquid content thereof through an outlet, the outlet having associated with it a control valve in the form of a flexible diaphragm carrying a nose or stud movable on deflection of the diaphragm between a position closing the outlet to prevent dispensing of the liquid and an open position permitting liquid to be dispensed through the outlet.

One such arrangement is disclosed in U.S. Pat. No. 5,454,494 in which the diaphragm is attached to a hollow cylindrical support element which, in turn, is located in a rigid insert positioned within the associated container and incorporating cylindrical passageways for the flow therethrough of liquid from the container to a dispensing chamber from which it can be discharged in accordance with deflection of the diaphragm resultant from pressurisation of the liquid within the container.

The assembly described in U.S. Pat. No. 5,454,494 suffers from a number of disadvantages not the least of which is that it comprises a number of components the constructions of which are relatively complex, and which are difficult to assemble.

In particular, the process of assembly is considerably complicated by the fact that the rigid insert is to be positioned within the upper regions of the container and must be inserted therein from the bottom of the container, only after which can the container be closed. Thus the described container is clearly not suited to high volume production.

Additionally, the construction of the insert is such that flow of liquid therethrough from the body of the container to the aforementioned dispensing chamber is restricted by virtue of the provision of cylindrical passageways the total cross-sectional area of which is considerably less than that of the container and/or the dispensing chamber.

It has been further proposed in U.S. Pat. No. 5,325,999 to provide an assembly which includes a compound flexible diaphragm part of which constitutes a domed control valve for opening and closing an associated outlet on deformation of the dome by pressurised liquid from the container. However, the assembly is again of relatively complex construction and is not suited to mass production.

Additionally, flow from the body of the container towards the outlet is by way of a single central passageway which imposes considerable restriction upon the rate of flow, and the nature, in particular the viscosity, of liquids that can be dispensed by the container, while the construction of the assembly is such that the outlet must be offset from the central passageway, therefore imposing restrictions on the position of the outlet from the assembly and eliminating the possibility of a centrally-located outlet which is often desirable.

DE-A1-4329808 discloses a container or tube in which liquid to be dispensed is supplied to a dispensing chamber through a pair of diametrically opposed flow openings. These openings comprise narrow cylindrical passageways the total cross-sectional area of which is again considerably less than that of the container and/or the dispensing chamber, and whereby liquid flow to the dispensing chamber is significantly restricted.

U.S. Pat. No. 2,695,119 discloses a collapsible tube which delivers liquid to a chamber in a cap for the tube by way of a plurality of narrow bores defined in an axially movable plug within the tube, dispensing of the liquid through an outlet in the cap being under the control of a valve member seating on the movable plug, the valve member defining therein an internal volume which is vented to atmosphere through an angled bore formed in the plug and aligned with, at one end, an opening in the lower wall of the valve member and, at the other end, an opening in the wall of the cap.

The overall assembly as disclosed is of complex construction, is difficult to assembly and provides for restricted flow of liquid from the tube to the chamber within the cap.

Reference is also made to U.S. Pat. No. 2,607,515 and U.S. Pat. No. 2,643,794 both of which disclose containers the constructions of which are such that manufacture and assembly thereof both pose difficulties.

SUMMARY OF THE INVENTION

It would be desirable to be able to provide a container for dispensing liquid which is of simpler construction and which lends itself to automated assembly whereby high volume production can be achieved, and which enables improved flow characteristics to be achieved and a wider range of liquids to be handled compared with the known arrangements.

According to the present invention there is provided a container comprising a body member for containing liquid and including an outlet portion at one end thereof through which said liquid flows on pressurization of the interior of the body member, a cap portion located on the body member and having at least one outlet for dispensing therethrough liquid flowing from the outlet portion of the body member, and a control assembly located within the cap portion for controlling the dispensing of liquid flowing from the body member to the or each outlet from the cap portion, the control assembly comprising, for the or each outlet, a control valve and a seating for said control valve, the control valve being a one-piece plastic moulding and including a diaphragm portion, and a nose portion extending from said diaphragm portion, and the seating comprising an outer annular sleeve forming an extension of the outlet portion of the body member within the cap portion, and, within said sleeve, a support chamber for the valve, said valve having a rest position with the nose portion thereof engaging in, to seal, the associated outlet in the cap portion, the arrangement being such that, on pressurization of the interior of the container, liquid from the body member flows along the flow path through the seating between the outer annular sleeve thereof and the valve support chamber to engage with and distort the diaphragm portion of the valve whereby the nose portion of the valve is released from the outlet and liquid is dispensed therethrough, and, on subsequent release of pressure from the interior of the body member, the control valve returns to its rest position with the nose portion thereof seating in, to seal, the outlet, characterized in that the seating is a one-piece plastic moulding with the support chamber thereof comprising sidewalls defining an open top to the support chamber, the valve seating on the open top of, in sealing engagement with, the support chamber to define an internal volume within said chamber below the valve, the sidewalls of the support chamber being interconnected with the outer annular sleeve by means of a plurality of thin, circumferentially spaced webs such that a substantial proportion of the volume between the sleeve and the support chamber is available for liquid to flow therethrough from the body member to the or each outlet, the bore or bores extending from the support chamber through the sidewalls thereof, through one or more of the webs and through the annular sleeve to vent the internal volume within the support chamber to atmosphere.

It will be appreciated that, with such an arrangement, the or each control valve and the seating therefor are each of unitary construction and are each moulded from a suitable plastics material whereby the number of component parts to the container is minimised and assembly is considerably easier than heretofore.

The venting of the valve support chamber to atmosphere, as well as preventing the build-up of pressure within the closed volume below the valve during assembly that could otherwise occur and preventing such pressure build-up in, for example, high temperature environments, and which could adversely affect movement of the valve between its open and closed positions, supplements the natural resiliency of the control valve to ensure a rapid and positive return of the control valve to its rest position on release of pressure from the interior of the body member.

Furthermore, the provision of the relatively substantial volume between the outer sleeve and the valve support chamber, interrupted only by the relatively narrow connecting webs, provides for excellent flow characteristics from the body member to the or each outlet from the cap portion, and enables liquids with a wide range of viscosities to be dispensed by the container.

The container may include one-way valve means which, on pressurisation of the interior of the container, are closed to disconnect said interior from the atmosphere, and, on release of pressure from the interior of the body member, are opened to connect the interior of the container to the atmosphere.

Conveniently the one-way valve means comprise, or are provided in, the base wall of the support chamber.

In one embodiment of the invention, the control valve includes a cylindrical skirt portion one end of which is closed by the diaphragm portion, the skirt portion seating on, to surround, the upper regions of the sidewalls of the support chamber whereby the control valve is sealingly located on the support chamber.

In such an embodiment, the skirt portion of the control valve may be overmoulded on the upper regions of the sidewalls of the support chamber.

In an alternative embodiment of the invention, the control valve includes a cylindrical skirt portion one end of which is closed by the diaphragm portion, the skirt portion being received within the upper region of the sidewalls of the support chamber whereby the valve is sealingly located in said chamber.

In the alternative embodiment of the invention, the upper regions of the sidewalls of support chamber may be provided with an annular recess adapted to receive therein the skirt portion of the valve whereby the valve is sealingly located within the upper regions of the chamber.

The outlet portion of the body member may be defined by a cylindrical neck, the outer sleeve of the seating embracing said neck to locate the seating on the body member. The outer sleeve may be, for example, a snap fit on the neck, or may be threaded thereon.

The outlet portion of the body member may be defined by a cylindrical neck, the outer annular sleeve of the seating being integrally moulded with said neck whereby the body member and seating comprise a single component.

Preferably the cap portion is movable relative to the body member between a closed position preventing flow from the body member to the or each outlet, and a dispensing position permitting flow from the body member to the or each outlet on pressurisation of the interior of the body member.

The movement of the cap portion between the closed and dispensing positions may be achieved, for example, by axial displacement of the cap portion on the body member, or by rotary displacement of the cap portion relative to the body member.

Alternatively, the cap portion may be integrally moulded with the seating to be hingedly movable relative thereto between an operative position closing the container and housing the or each control valve therein, and an inoperative position providing access to the control valve and seating.

A container according to the invention may include a lid member mounted on, externally of, the cap portion and provided with, for the or each outlet, a plug portion, the lid member being movable between a closed position in which the or each plug portion seats in, to seal, the associated outlet, and an open position in which the or each plug portion is displaced from its associated outlet.

Preferably the lid member is integrally moulded with the cap portion and is pivotal relative to the cap portion about a reduced thickness hinge between its open and closed positions.

In a further embodiment of the invention, the container includes a plurality of outlets, and, within the container, a plurality of control valves and associated seatings, one for each outlet, the seatings being integrally formed with one another, the container further including, externally thereof, a plurality of bristles projecting therefrom at regions adjacent the outlets to receive thereon the content of the container when dispensed therefrom, and for use as a brush.

Alternatively, the bristles may be replaced by a sponge or like applicator external of the container, for example for shoe care or polishing purposes.

In a preferred embodiment of the invention, the body member of the container is of a flexible plastics material whereby pressurisation of the interior thereof, and consequential dispensing therefrom, can be achieved by squeezing the body member.

The control valve is conveniently of a soft thermoplastic material, for example an elastomer, or a silicone rubber such as to ensure a leak-tight, non-drip seal of the nose portion with the associated outlet as well as a leak-tight seal of the skirt portion of the valve in the support chamber.

DESCRIPTION OF THE PREFERRED EMBODIMENTS

Figure 1:
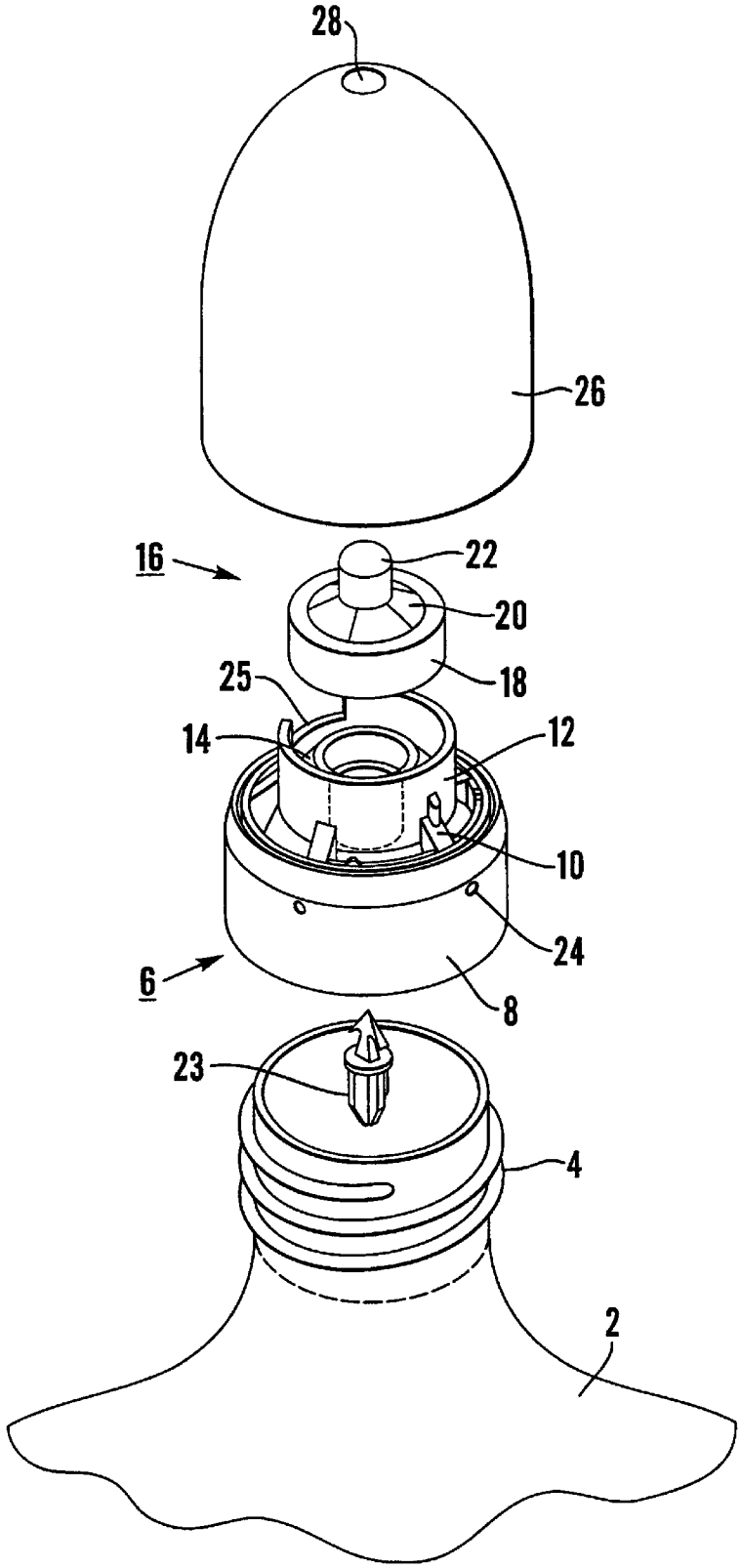
FIG. 1 is an exploded isometric view of part of a first container according to the invention.
Figure 1A:
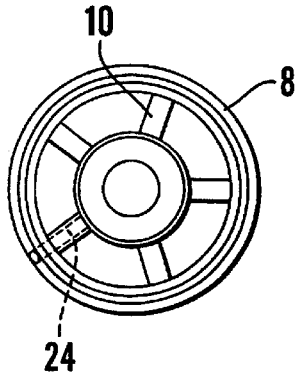
FIG. 1*a* is a plan view of the seating of the container in FIG. 1.

Referring to FIGS. 1 and 1*a* there is shown part of a container comprising a body portion or reservoir 2 of a flexible plastics material and including an externally threaded neck 4.

A valve seating of, for example, high density polyethylene is indicated generally at 6 and includes an outer annular sleeve 8 in the lower regions of which is formed an internal channel adapted to seat over, and threadedly engage, the neck 4 of the container whereby the seating 6 is secured on the body portion 2 with the internal wall of the sleeve 8 lying within the neck 4 and defining an outlet from the body portion 2.

Integrally moulded with the sleeve 8, and connected thereto by a plurality of thin, circumferentially spaced ribs 10, is a cylindrical valve support chamber 12 the upper and lower ends of which are initially open. The upper regions of the chamber 12 have an annular recess 14 formed therein for reasons which will become apparent.

A control valve of a soft thermoplastic elastomer or a silicone rubber is indicated generally at 16 and comprises an annular skirt portion 18 the upper end of which is closed by a circular diaphragm portion 20 on the upper surface of which is formed a central nose portion 22.

The skirt portion 18 of the control valve 16 is a close friction fit in the recess 14 in the chamber 12 whereby the valve 16 is sealingly located in the upper regions of the chamber 12. Alternatively, and in order to ensure sealing engagement on the chamber 12, the skirt portion 18 of the valve may be overmoulded on the chamber 12.

The volume within the chamber 12 below the valve 16 is vented to atmosphere, one or more bores 24 being formed in the seating 6 to extend from the lower regions of the chamber 12 along and through one or more of the webs 10 to exit through the sleeve 8 whereby the volume within the lower regions of the chamber 12 is connected by said bores 24 to the atmosphere.

The lower end of the chamber 12 is apertured to receive therein an air-plug or one-way valve 23, this valve 23 having, as will be described in more detail below, a first position which seals the lower end of the chamber 12 to define a closed volume therein vented to atmosphere via the bores 24, and a second position interconnecting the chamber 12 with the interior of the container.

The upper extent of the defining wall of the chamber 12 projects upwardly beyond the upper surface of the diaphragm portion 20 of the valve 16 when the valve 16 is located within the chamber 12, a slot 25 being formed in said upper extent of said wall, for reasons which will become apparent.

The container is completed by a cap 26, for example of high density polythene, having a central outlet 28 therein and being a snap fit over the sleeve 8 of the seating 6 and rotatable relative thereto.

The cap 26 includes, on its inner surface, an annular projection which engages with the upper free end of the wall of the chamber 12, and an internal closure plate which, with the cap 26 in its closed position, seals over the slot 25 to define, together with the aforementioned projection, a closed volume within the cap 26 immediately above the valve 16. In said closed position of the cap 26, the nose portion 22 of the valve 16 seats in, to seal, the outlet 28.

In order to dispense the content of the container, the cap 26 is rotated to displace the closure plate from the slot 25, and the body portion 2 of the container is squeezed to pressurise the interior of the container. This increased pressure forces the content of the container through the annular volume between the sleeve 8 and the outer wall of the chamber 12, restricted only by the narrow ribs 10, through the slot 25 in the wall of the chamber 12 and into forcible engagement with the upper surface of the diaphragm portion 20 of the valve 16.

The diaphragm portion 20 is thus displaced downwardly within the chamber 12 whereby the nose portion 22 is displaced from the outlet 28 and the content of the container is dispensed through said outlet 28.

At the same time the increased pressure in the container forces the one-way valve 23 into its first position sealing the aperture in the lower end of the chamber 12 and preventing flow of liquid from the container into the chamber 12 and preventing flow of air from the chamber 12 into the container.

On release of the squeezing pressure from the body portion 2, and by virtue of its inherent resiliency and the consequential return flow of air through the bores 24 to the closed volume within the chamber 12, the valve 16 returns to its normal rest condition in which the nose portion 22 thereof seats in and seals the outlet 28, thereby terminating dispensing of the content from the container.

At the same time the one-way valve 23 is moved to its second, open position as a result of the pressure difference thereacross to enable atmospheric air to flow from the chamber 12 into the container through the lower end of the chamber 12 thereby to assist return of the container to its normal rest condition.

Although not essential, the provision of the one-way valve 23 is particularly useful in facilitating the return of the container to its natural shape which might otherwise be rather slow.

Although shown as communicating into the chamber 12, the one-way valve 23 could be provided in, for example, one of the bores 24 or otherwise in communication with the atmosphere, in which case the lower end of the chamber 12 would be closed by a transverse wall 13.

The venting of the closed volume within the chamber 12 below the valve 16 to atmosphere, as well as assisting return of the displaced valve 16 to its normal rest condition on release of pressure within the body portion 2, prevents pressure build up in that volume during assembly, and prevents such pressure build-up due to, for example, high ambient temperatures which could adversely affect movement of the valve 16 between its open and closed positions.

It will be appreciated that the described container is of relatively simple and therefore inexpensive construction, in particular as the seating 6 and the valve 16 are each integrally moulded, unitary components readily located on the body portion 2—the number of components may in fact be further reduced by moulding the seating 6 integrally with the body portion 2. Such an arrangement is therefore particularly suited to robotic assembly.

Additionally, flow of the liquid content from the body portion 2 to the outlet 28 is considerably improved compared with known arrangements regardless of viscosity by providing a substantial volume between the sleeve 8 and the chamber 12 for passage therethrough of the liquid which is impeded only by the narrow interconnecting ribs 10.

The valve 16 functions at the exact point of dispensation of the product and eliminates the build-up of unsightly and unhygienic unused product at the outlet from the container and ensuring a reliable non-drip action. The container of the invention is designed with a more attractive and hygienic appearance compared with current containers and has a very flexible and broad range of interesting and diverse marketing applications.

By dispensing through the top of the container, the product, which may be cream, gel, paste or the like, can be applied directly to, for example, a hand or a leg and simply cleaned by wiping the cap against this surface.

The self-sealing action of the control valve 16 in the outlet 28 means that the container can be left in the open position of the cap 26, whether upright or inverted, and ready for immediate use without the usual hazard of potential spillage.

The closed position of the cap 26 provides leak-proof security for travel purposes or for other situations where inadvertent squeezing of the container might occur.

The precise means by which the cap 26 is moved from a closed position to an open position may vary, while, in the rotatable arrangement of FIG. 1, there may be a series of slots 25 around the top of the chamber 12 and an associated series of closure plates internal of the cap 26.

Figure 2A:
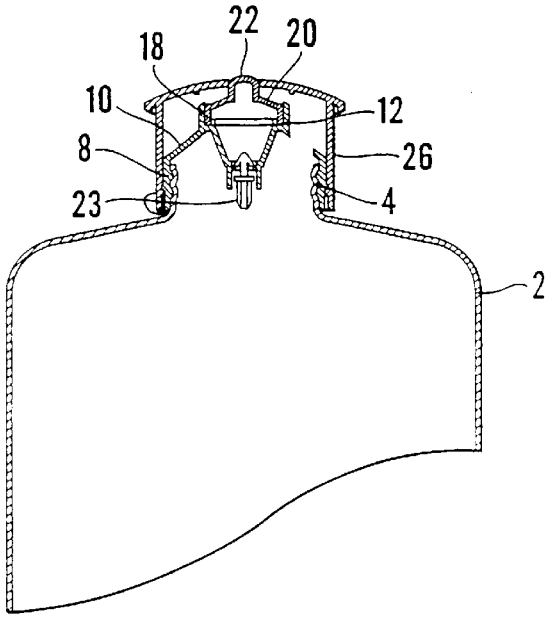
FIGS. 2*a*, 2*b*, and 2*c* are vertical sections through a container according to the invention and incorporating a rotatable cap with the cap portion in its dispensing position, with the interior of the container under pressure, and with the cap portion in its closed position respectively.
Figure 2B:
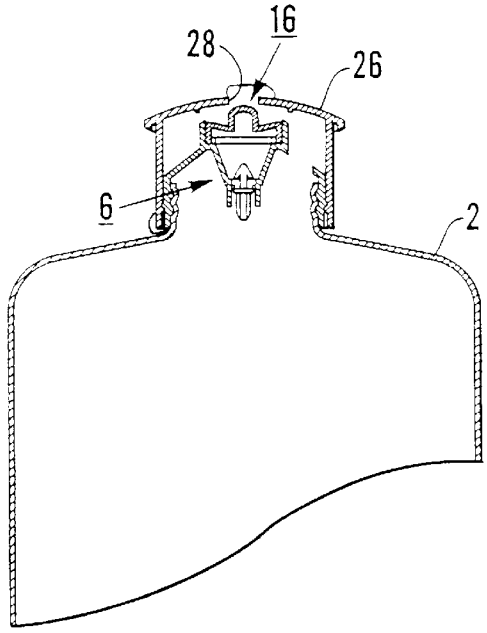
Figure 2C:
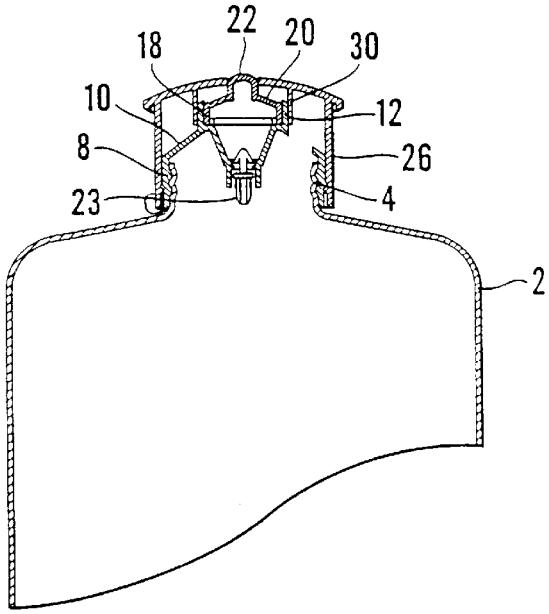

FIGS. 2*a* to 2*c* show an arrangement similar to that of FIG. 1 in which equivalent components are correspondly referenced. Closure plates 30 are provided within the cap 26 to co-operate with the chamber 12 and cover over the slots 25 when the cap 26 is in the closed position of FIG. 2*c*.

FIG. 2*a* shows the cap in its open position, for example rotated through 90° from its closed position, and FIG. 2*b* shows liquid being dispensed through the outlet 28 on squeezing the body portion 20 of the valve 16 and the consequential downward displacement of the nose portion 22 can be clearly seen in FIG. 2*b*.

Figure 3A:
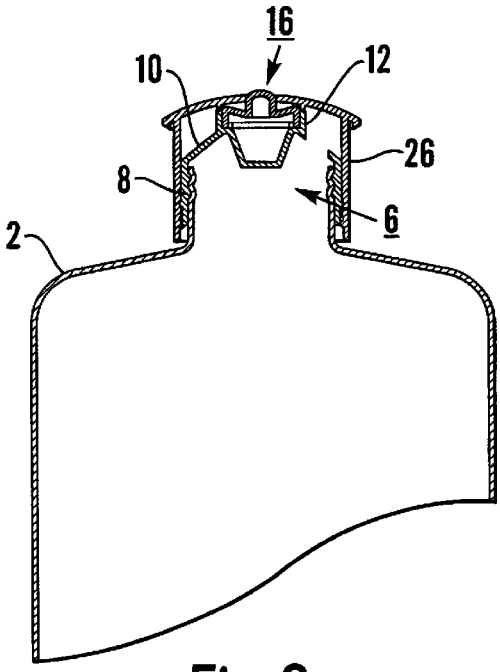
FIGS. 3*a*, 3*b*, and 3*c* are vertical sections through a container according to the invention and incorporating an axially movable cap portion with the cap portion in its closed position, with the cap portion in its dispensing position, and with the interior of the container under pressure respectively.
Figure 3B:
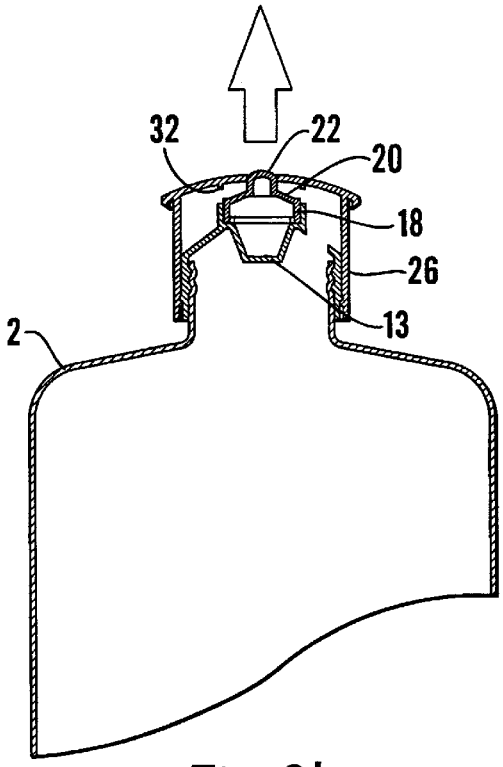
Figure 3C:
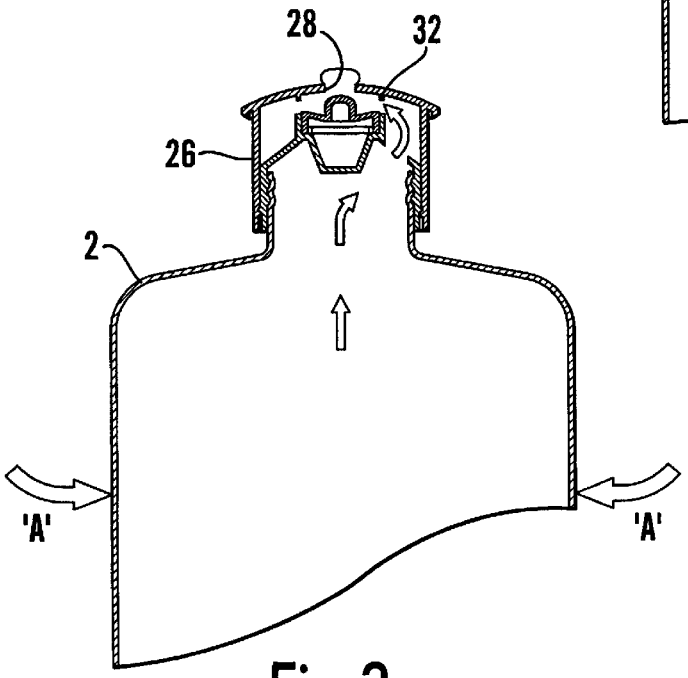

Movement of the cap 28 from its closed position to its open position may be achieved by axial displacement of the cap relative to the body portion 2 of the container, for example as illustrated in FIGS. 3*a* to 3*c*.

More particularly, this embodiment does not include slots 25 in the upper extent of the chamber 12, this chamber 12 having a continuous circular upper edge thereto. The cap 26 includes, on its internal surface, an annular projection 32 which, with the cap 26 in its closed position, engages the upper free edge of the chamber 12 to form a closed volume above the valve 16 and seal the outlet 28 from the interior of the container.

Furthermore, in this closed position of the cap 26, the valve 16 is resiliently displaced by the cap 26 from a normal rest position to a compressed position on the seating 6 as shown in FIG. 3*a*.

On axially upward movement of the cap 26 to the position shown in FIG. 3*b*, the projection 32 on the cap 26 is disengaged from the chamber 12, and the valve 16 is released into its normal rest condition in which the nose portion 20 thereof seats in, to seal, the outlet 28, and the contents of the container 2 bound the valve 16 within the cap 26.

Dispensing of the content of the container 2 is achieved by squeezing the body portion 2 of the container as indicated by the arrows A' in FIG. 3*c* whereby the interior of the container is pressurised and liquid is dispensed as previously described.

It will be appreciated that the cap position of FIG. 3*a* provides positive closure of the container, for example to ensure no discharge or spillage therefrom when travelling.

The embodiment of FIGS. 3*a* to 3*c* does not include an air plug or one-way valve 23, the lower end of the chamber 12 being closed by a transverse wall 13. This embodiment is particularly useful for containers such as laminated tubes containing highly viscous products.

Figure 4:
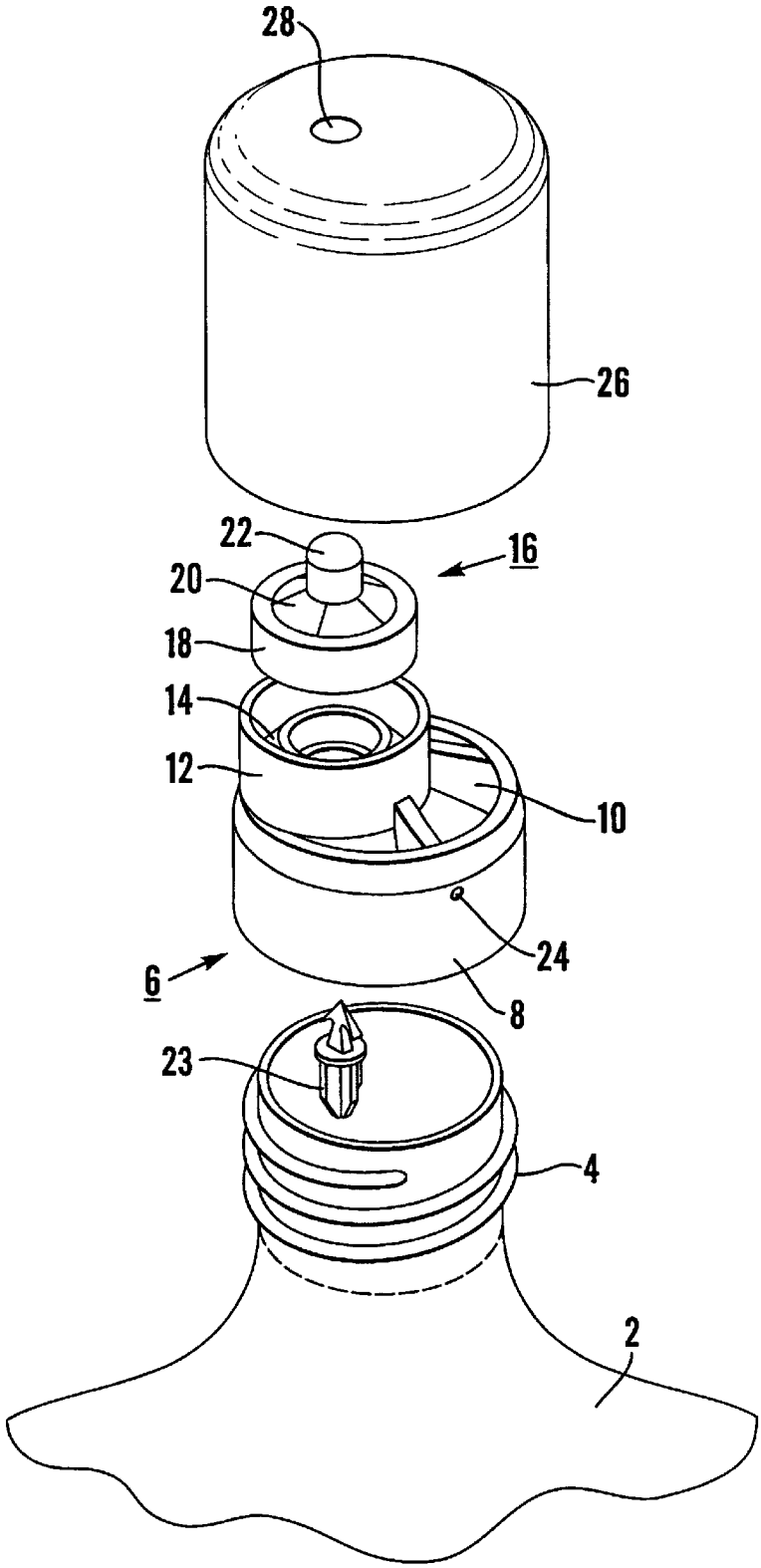
FIG. 4 is an exploded isometric view of part of a further container according to the invention.
Figure 4A:
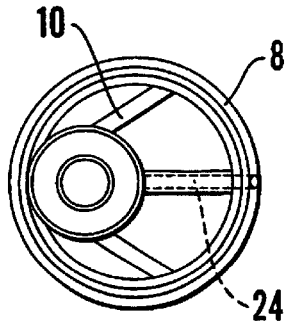
FIG. 4*a* is a plan view of the seating of the container of FIG. 4.

FIG. 4 illustrates a modified seating compared with that of FIGS. 1 and 1*a*. More particularly, the chamber 12 is offset from the centre of the sleeve 8 and supports therein a valve 16 which controls flow through an outlet 28 correspondingly offset from the centre of the cap 26. The interconnecting ribs 10 are accordingly displaced whereby the volume between the sleeve 8 and the chamber 12 for liquid flow therethrough is crescent shaped rather than annular. However, the general mode of operation and the advantages compared with the prior art are the same as or similar to those described in relation to the embodiment of FIG. 1. Clearly the precise relative locations of the sleeve 8 and the chamber 12 can be varied as required, as can the basic shape of the seating 6 as a whole—it may be for example oval or elliptical rather than round, while opening of the cap 26 may be achieved by axial movement thereof in the manner of the embodiment of FIGS. 3*a* to 3*c*. Again, a venting bore 24 is shown extending from the lower regions of the chamber 12 to atmosphere through one of the ribs 10.

Figure 5:
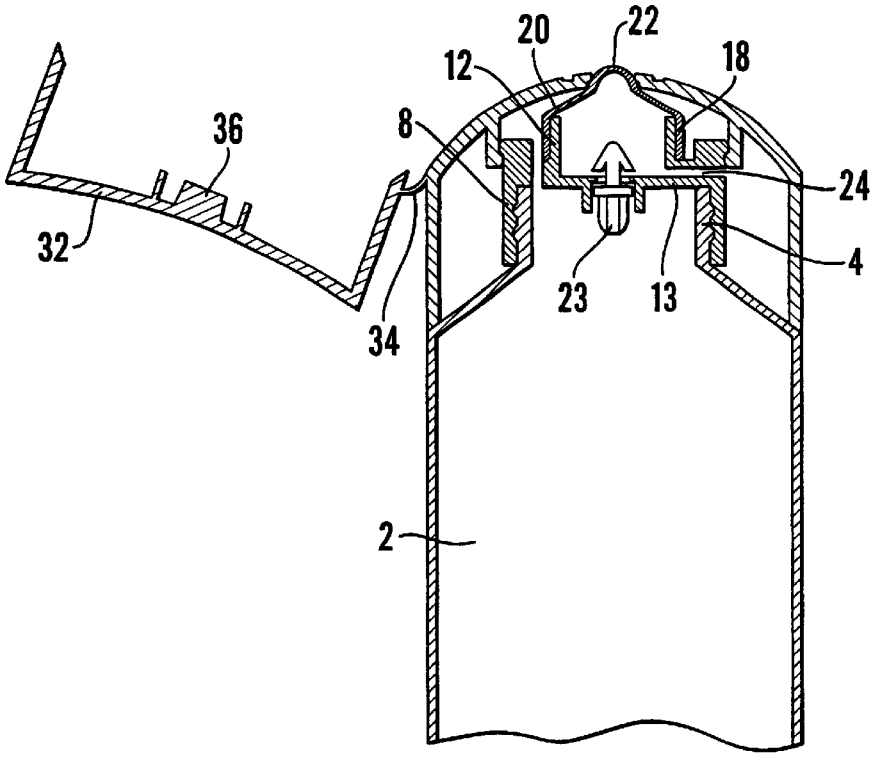
FIGS. 5 and 6 are vertical sections through part of a still further container according to the invention with the lid member in its open position and its closed position respectively.
Figure 6:
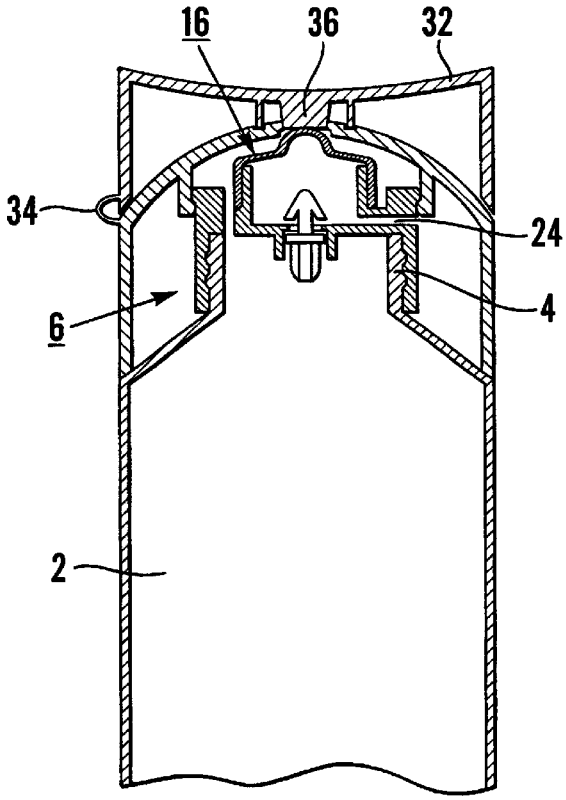

FIGS. 5 and 6 illustrate an embodiment similar to that of FIG. 1 but incorporating a lid member 32 integrally moulded with the cap 26 and connected thereto by a reduced thickness living hinge 34, the lid member 32 including a central depending plug 36 which, with the lid member 32 in the closed position of FIG. 6, seats in, to close, the outlet 28, said plug 36 displacing the nose portion 22 of the valve 16 from the outlet 28 and deforming the diaphragm portion 20 of the valve 16 as seen in FIG. 6. This closed position of the lid member 32 prevents inadvertent dispensing from the container during travelling or the like.

In an alternative arrangement, the plug 36 may be replaced by a cover to seat over the outlet 28 rather than extending into the outlet 28.

The lid member 32 can be pivoted about the hinge 34 to the open position of FIG. 5 whereby dispensing can be effected as required. A vent bore 24 between the closed volume in the lower regions of the chamber 12 and the atmosphere is clearly shown in FIGS. 5 and 6.

In an unillustrated embodiment of the invention, the cap 26 is integrally moulded with the seating 6 and is connected thereto by a reduced thickness living hinge, thus further reducing the number of parts to the container.

Additionally, the seating 6 may be integrally moulded with the body portion 2, and the body portion 2, seating 6, cap 26 and lid member 32 may comprise a unitary component.

Figure 7A:
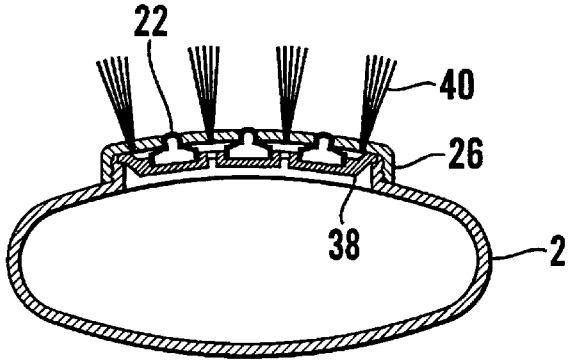
FIGS. 7*a* and 7*b* are vertical sections through a container according to the invention with a number of outlets with the valves in their rest positions and their displaced positions respectively.
Figure 7B:
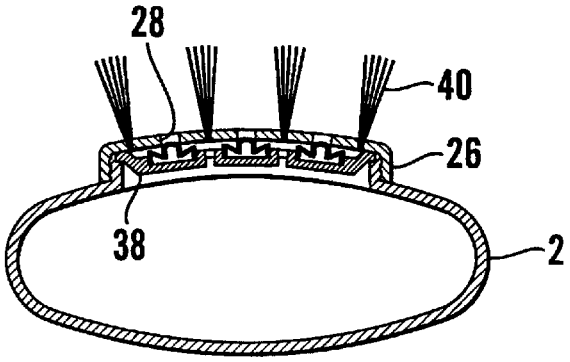

FIGS. 7*a* and 7*b* show a modified version of the container of the invention for applying the content of the container in the manner of a brush.

More particularly, the squeezable body portion 2 includes three separate valves 16 each of which is supported on its own associated seating 6, the three seatings being integrally formed with one another into a single support member 38. The three valves 16 may themselves be interconnected for ease of assembly.

A cover or cap 26 is a snap-fit on the body portion 2 and includes three outlets 28 in each of which is received the nose portion 22 of the associated valve 16 to seal said outlets 28 in the manner of the previous embodiments.

Sets of bristles 40 are provided externally of the cover 26 between the outlets 28, and it will be appreciated that, on squeezing of the body portion 2, the content of the container is dispensed through the outlets 28 onto the bristles 40 for subsequent application as required, the valves 16 working in unison with one another.

The nose portions 22 of the valves 16 may extend right through and beyond the associated outlets 28 to facilitate application of the contents of the container to the bristles 40, while the bristles 40 could be replaced by sponge, cloth or other application mediums, for example for shoe care and polishing purposes.

In the above-detailed embodiments, the control valve 16 is described as being a separate component from, and sealingly located in the chamber 12 of, the seating 6 However, and as previously mentioned, the control valve may be integral with the seating, for example by being overmoulded to the top of the chamber 12, thus further reducing the number of parts to the container.

In one arrangement, the control valve 16 may exclude a skirt portion 18, the outer edge regions of the lower surface of the diaphragm portion 20 remote from the nose portion 22 being moulded to the upper regions of the chamber 12 to define a closed volume within the chamber 12 below the diaphragm portion 20.

Clearly the precise construction of the containers could differ further from those described and illustrated without departing from the scope of the invention. For example, the nose portion 22 of the or each valve 16 may be narrow and received within a correspondingly narrow outlet 28 whereby a spray action is achieved on pressurisation of the interior of the container. Furthermore, the nose portion 22 of the or each valve 16 may be other than rounded, and may have, for example, a concave outer end thereto.

Figure 8:
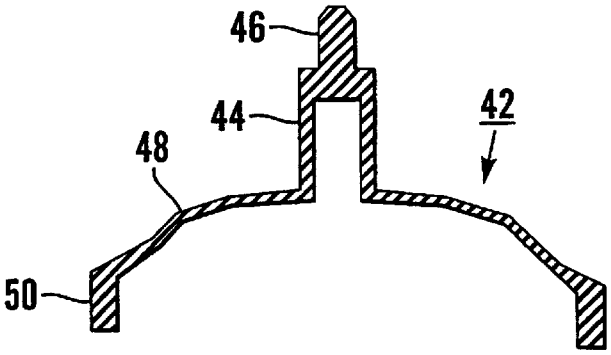
FIG. 8 shows, to a larger scale, an alternative control valve for a container according to the invention.

FIG. 8 shows an alternative control valve indicated generally at 42, the nose portion of which comprises a hollow cylindrical stem 44 terminating in a soft rubber plug portion 46. The diaphragm portion is indicated at 48 and is of a stepped configuration terminating in a depending skirt portion 50. Other modifications and variations will be apparent to those skilled in the art.

Although pressurisation of the content of the container has been described as being achieved by distortion of the container itself, this pressurisation for dispensing purposes may be achieved by, for example, pump means within the container.

Thus there is described a container of relatively simple construction capable of economic production and automated assembly that provides the consumer with numerous advantages compared with currently available products.

In particular, the container of the invention enables the consumer to dispense smooth, measured quantities either in small doses or large doses and regardless of the viscosity of the liquid.

The sizes of the outlets and the valves can readily be altered to suit different products and the dispensing requirements of the consumer, and can accommodate a wide range of products from highly viscous pastes right through to water.

The containers may be of the upright, semi-rigid type or may be of the inverted tube type. In all cases, and regardless of orientation, the outlets are sealed by virtue of the resilient nature of the control valve.

The venting of the valve support chamber to atmosphere allows the container to return rapidly to its normal condition and ensures immediate and effective movement of the control valve to and from its rest and displaced positions. Furthermore the venting system is operable even when the outlet 28 is closed.

The provision of an initially open lower end to the chamber 12 enables ready overmoulding of the control valve to the upper end of the chamber 12, in that the relevant die can be inserted up through the chamber from below and the appropriate moulding effected. The one-way valve 23 can then be inserted into its operative position in the base of the chamber 12.

What is claimed is:

1. A container comprising a body member for containing liquid and including an outlet portion at one end thereof through which said liquid flows on pressurization of the interior of the body member, a cap portion located on the body member and having at least one outlet for dispensing therethrough liquid flowing from the outlet portion of the body member, and a control assembly located within the cap portion for controlling the dispensing of liquid flowing from the body member to the or each outlet from the cap portion, the control assembly comprising, for the or each outlet, a control valve and a seating for said control valve, the control valve being a one-piece plastic moulding and including a diaphragm portion, and a nose portion extending from said diaphragm portion, and the seating comprising an outer annular sleeve forming an extension of the outlet portion of the body member within the cap portion, and, within said sleeve, a support chamber for the valve, said valve having a rest position with the nose portion thereof engaging in, to seal, the associated outlet in the cap portion, one or more bores extending from the support chamber, the arrangement being such that, on pressurization of the interior of the container, liquid from the body member flows along the flow path through the seating between the outer annular sleeve thereof and the valve support chamber to engage with and distort the diaphragm portion of the valve whereby the nose portion of the valve is released from the outlet and liquid is dispensed therethrough, and, on subsequent release of pressure from the interior of the body member, the control valve returns to its rest position with the nose portion thereof seating in, to seal, the outlet, characterized in that the seating is a one-piece plastic moulding with the support chamber thereof comprising sidewalls defining an open top to the support chamber, the valve seating on the open top of, in sealing engagement with, the support chamber to define an internal volume within said chamber below the valve, the sidewalls of the support chamber being interconnected with the outer annular sleeve by means of a plurality of thin, circumferentially spaced webs such that a substantial proportion of the volume between the sleeve and the support chamber is available for liquid to flow therethrough from the body member to the or each outlet, the bore or bores extending from the support chamber through the sidewalls thereof, through one or more of the webs and through the annular sleeve to vent the internal volume within the support chamber to atmosphere.

2. A container as claimed in claim 1 and including one-way valve means which, on pressurization of the interior of the container, are closed to disconnect said interior from the atmosphere, and, on release of pressure from the interior of the body member, are opened to connect the interior of the container to the atmosphere.

3. A container as claimed in claim 2 in which the one-way valve means comprise, or are provided in, a transverse base wall of the support chamber.

4. A container as claimed in claim 1 in which the control valve includes a cylindrical skirt portion one end of which is closed by the diaphragm portion, the skirt portion seating on, to surround, the upper regions of the sidewalls of the support chamber whereby the control valve is sealingly located on the support chamber.

5. A container as claimed in claim 4 in which the skirt portion of the control valve is overmoulded on the upper regions of the sidewalls of the support chamber.

6. A container as claimed in claim 1 in which the control valve includes a cylindrical skirt portion one end of which is closed by the diaphragm portion, the skirt portion being received within the upper regions of the sidewalls of the support chamber whereby the control valve is sealingly located in said support chamber.

7. A container as claimed in claim 6 in which the upper regions of the sidewalls of the support chamber are provided with an annular recess adapted to receive therein the skirt portion of the valve whereby the valve is sealingly located within the upper regions of the chamber.

8. A container as claimed in claim 1 in which the outlet portion of the body member is defined by a cylindrical neck, the outer sleeve of the seating embracing said neck to locate the seating on the body member.

9. A container as claimed in claim 1 in which the outlet portion of the body member is defined by a cylindrical neck, the outer annular sleeve of the seating being integrally moulded with said neck whereby the body member and seating comprise a single component.

10. A container as claimed in claim 1 in which the cap portion is movable relative to the body member between a closed position preventing flow from the body member to the or each outlet, and a dispensing position permitting flow from the body member to the or each outlet on pressurization of the interior of the body member.

11. A container as claimed in claim 10 in which movement of the cap portion between the closed position and the dispensing position is achieved by axial displacement of the cap portion on the body member.

12. A container as claimed in claim 10 in which movement of the cap portion between the closed position and the dispensing position is achieved by rotary displacement of the cap portion relative to the body member.

13. A container as claimed in claim 1 in which the cap portion is integrally moulded with the seating to be hingedly movable relative thereto between an operative position closing the container and housing the or each control valve therein, and an inoperative position providing access to the control valve and seating.

14. A container as claimed in claim 1 and including a lid member mounted on, externally of, the cap portion and provided with, for the or each outlet, a plug portion, the lid member being movable between a closed position in which the or each plug portion seats in, to close, the associated outlet, and an open position in which the or each plug portion is displaced from its associated outlet.

15. A container as claimed in claim 14 in which the lid member is integrally moulded with the cap portion and is pivotal relative to the cap portion about a reduced thickness hinge between its open and closed positions.

16. A container as claimed in claim 1 and including a plurality of outlets, and, within the container, a plurality of control valves and associated seatings, one for each outlet, the seatings being integrally formed with one another, the container further including, externally thereof, a plurality of bristles projecting therefrom at regions adjacent the outlets to receive thereon the content of the container when dispensed therefrom, and for use as a brush.

17. A container as claimed in claim 1 in which the body member of the container is of a flexible plastics material whereby pressurization of the interior thereof, and consequential dispensing therefrom, can be achieved by squeezing the body member.

18. A container as claimed in claim 1 in which the control valve is of a soft thermoplastic material.

* * * * *

UNITED STATES PATENT AND TRADEMARK OFFICE

CERTIFICATE OF CORRECTION

PATENT NO. : 6,332,730 B1
DATED : December 25, 2001
INVENTOR(S) : Taghavi-Khanghah It is certified that error appears in the above-identified patent and that said Letters Patent is hereby corrected as shown below:

Title page,
Item [30], under the heading Foreign Application Priority Data, list the data as follows:

Aug. 3, 1998 [WO] WIPO……..PCT/GB98/02326

Signed and Sealed this

Second Day of July, 2002

*Attest:*

*Attesting Officer*

JAMES E. ROGAN
*Director of the United States Patent and Trademark Office*